US005651229A

United States Patent [19]

Wada et al.

[11] Patent Number: 5,651,229

[45] Date of Patent: Jul. 29, 1997

[54] STRUCTURAL COMPONENT

[75] Inventors: Hiroo Wada, Tokyo; Koichiro Nawa, Kurobe, both of Japan

[73] Assignee: YKK Architectural Products Inc., Tokyo, Japan

[21] Appl. No.: 405,707

[22] Filed: Mar. 17, 1995

[30] Foreign Application Priority Data

Mar. 18, 1994 [JP] Japan ..... 6-48528

[51] Int. Cl.[6] ..... E04B 2/88; E04C 3/00

[52] U.S. Cl. ..... 52/693; 52/235; 52/655.1; 52/653.2; 52/656.2; 52/204.2

[58] Field of Search ..... 52/204.2, 638, 52/653.1, 653.2, 654.1, 655.1, 656.1, 656.2, 656.4, 693, 235, 733.4, 737.2, 730.3, 730.4, 690, 694, 656.9, 650.1

[56] References Cited

U.S. PATENT DOCUMENTS

| | | | |
|---|---|---|---|
| 889,223 | 6/1908 | Graham | 52/653.2 |
| 2,467,558 | 4/1949 | Kapnek | 52/690 X |
| 2,936,051 | 5/1960 | Martin | 52/650.1 X |
| 3,007,232 | 11/1961 | Thiry | 52/693 X |
| 3,111,207 | 11/1963 | Braddod | 52/650.1 |
| 3,562,994 | 2/1971 | Von Linsowe | 52/690 X |
| 3,564,783 | 2/1971 | Dunne | 52/693 X |
| 4,930,930 | 6/1990 | Coppa | 52/693 X |
| 4,961,297 | 10/1990 | Bernard | 52/655.1 X |
| 5,054,964 | 10/1991 | Salzmann et al. | 52/650.1 X |
| 5,205,101 | 4/1993 | Swan et al. | 52/737.2 X |
| 5,390,463 | 2/1995 | Sollner | 52/653.2 X |

FOREIGN PATENT DOCUMENTS

| | | | |
|---|---|---|---|
| 1294033 | 4/1962 | France | 52/690 |
| 3-52672 | 12/1992 | Japan . | |
| 2124268 | 2/1984 | United Kingdom | 52/690 |
| 2281086 | 2/1995 | United Kingdom | 52/690 |

*Primary Examiner*—Robert Canfield

*Attorney, Agent, or Firm*—Finnegan, Henderson, Farabow, Garrett & Dunner, L.L.P.

[57] ABSTRACT

A structure component 7 composed of a vertical-load support trussed structure supporting a load in a vertical direction and arranged along a vertical plane and a horizontal-load support trussed structure supporting a load in a horizontal direction and arranged along a horizontal plane is provided between main mullions 4 in a building. Since the structure component 7 supports the vertical load and the horizontal load at the trussed structures 9, 10, a support strength can define responding to the loads so as to support efficiently.

17 Claims, 10 Drawing Sheets

STRUCTURAL COMPONENT

BACKGROUND OF THE INVENTION

1. Field of the Invention

The present invention relates to a structural component attached between vertical structures in a building to reinforce the vertical structures therewith and, more particularly to a component to strengthen mullions as the vertical structure when the mullions supporting a curtain wall are arranged in a building at relatively long intervals to each other in order to provide an opening for a door way in a building wall formed by the curtain wall.

2. Description of the Related Art

It has been known in the art that the curtain wall is a preferable material to form an outer wall of the building. The curtain wall is generally assembled such that a panel or "curtain wall unit", such as glass panel, aluminum panel or stone panel is hung on the mullions standing upward between the upper and lower floors.

Regarding the mullion, it has been known as being made from a square-shaped aluminum pipe or a steel H-beam or square pipe, but the present applicant proposed in Japanese Utility Model Application No. Hei 3-52672 (Japanese Utility Model Laid-open No. 4-137115), a mullion having the trussed structure consisting of two exterior and interior vertical members of cylindrical pipe and plural lattice trusses extending between and connecting to both vertical members. As has been taught, the mullion of the applicant assured high strength even if it did not have large sectional area, which was preferable to make a space for installation small compared with that in the conventional H-beam, and to be open.

The interval of two mullions side-by-side will be naturally determined based upon a dimension of the glass panel or a length of transom supporting the top and bottom of the glass. It is therefore required to consider the intervals of two mullions taking into account the strength of the glass panel.

Accordingly, the distance between two mullions could not be made large, so that it was impossible to have a large opening for a door way or a wind shield room at the building wall formed by the curtain wall.

Otherwise, if it is required to have a large opening at the curtain wall, one or more auxiliary beams will be additionally applied between the mullions for which intervals are relatively large in order to overcome the loss in strength, and to provide auxiliary mullions to support panels arranged over the opening. The auxiliary beam is generally a H-beam having a large area to obtain enough strength, so that a space occupied by the auxiliary beam tends to be large unexpectedly, spoiling the opening of the curtain wall covered with glass panels, and ruining the design as a whole.

The auxiliary beam of H-beam applied between the mullions to support the curtain wall further involves other disadvantages regarding space and to be open because its area should be considered so as to support two loads, one acting in a vertical direction by the weight of the curtain wall and the other acting in a horizontal direction by the wind.

In general, there is a scale gap between the vertical load and the horizontal load, but the auxiliary H-beam does not naturally correspond to such difference because of its shape, so that the H-beam should be chosen to bear a bigger load. Hence the selected beam is useless in view of weight control in a building.

The already mentioned mullion disclosed in the Japanese Utility Model Application No. Hei 3-52672 (Japanese Utility Model Laid-open No. 4-137115) is suitable to be intentionally disposed inside upon design, but in view of a safe structural design, such an auxiliary H-beam having a different structure compared with the trussed structure of the mullion does not ensure an effective load dispersion, transmission or design integration.

Accordingly, an object of the present invention is to effectively support both loads in the vertical and horizontal directions, does not require a relatively large area to obtain enough strength, much particular space for installation to improve to be open and plenty of members to reduce cost and to provide a structural component having enough strength.

Another object of the present invention is to provide a structural component capable of assembling easily without assembling error.

Still another object of the present invention is to provide a structural component keeping a substantial unification with the mullions in a structural and design view, which does not spoil the design even when it will be used inside of the building.

SUMMARY OF THE INVENTION

To attain this object, it is characteristic of a structural component of this present invention to provide between a vertical structure, such as mullions in a building, a vertical-load support trussed structure along a vertical plane and a horizontal-load support trussed structure along a plane (e.g., a horizontal plane) intersecting with the vertical plane, and to connect slantwise reinforcement members between these trussed structures.

The horizontal-load support trussed structure is composed of an exterior horizontal member and an interior horizontal member arranged parallel to each other in the horizontal plane and a connecting member such as a lattice truss connected to span between both of the exterior and interior horizontal members.

The vertical-load support trussed structure is composed of one horizontal member (e.g., an exterior horizontal member) being either the exterior horizontal member or the interior horizontal member, an auxiliary horizontal member arranged upward or downward from the one horizontal member (e.g., the downward horizontal member) to orient parallel to each other in a vertical plane against the above-mentioned horizontal member and the connecting member as the lattice truss connected to span between the auxiliary horizontal member and the horizontal member.

The reinforcement member is connected between the auxiliary horizontal member and the other horizontal member being either the exterior horizontal member or the interior horizontal member.

It is preferred that the exterior horizontal member, the interior horizontal member and the auxiliary horizontal member are connected pivotally with the vertical structural member by means of pins, and contact pins effecting a connection of the one horizontal member (either the exterior horizontal member or the interior horizontal member) which belongs both of the horizontal-load support trussed structure and the vertical-load support trussed structure and the other contact pins effecting connections of the other horizontal member (the auxiliary horizontal member and either the exterior horizontal member or the interior horizontal member) with the vertical structure being angularly oriented at a right angles.

It is also desired that the direction of the contact pin be oriented along potentially served shear force responding to either horizontal or vertical direction of a main load supported thereby.

Incidentally, the structural component of the present invention may be provided between the vertical structures in the building, which are composed of the trussed structure formed to connect with the connecting members such as the lattice truss between an interior vertical horizontal member and an exterior horizontal member.

When the structural component includes the aforementioned three horizontal members of the exterior horizontal member, the intrior horizontal member and the auxiliary horizontal member, it is preferable that the exterior horizontal member is oriented to span between the exterior vertical members of the vertical structure, the interior horizontal member is oriented to span between the interior vertical members of the vertical structure and the auxiliary horizontal member is oriented to span between the exterior vertical members or between the interior vertical members of the vertical structure.

Furthermore, the present invention is not intended to have a specific limitation of members composing the trussed structures of the afore-mentioned structural components, for example, a chord member such as the exterior horizontal member, the interior horizontal member and the auxiliary horizontal member, a shape and material of the connecting member, but the member used therein is, more preferably, of a round-shaped pipe made of aluminum which is lightweight, strong and easy to produce.

In the present invention, the structural component, which includes the horizontal-load trussed structure composed of spaning the connecting members between the exterior horizontal member and the interior horizontal member arranged parallel to each other in the plane (e.g., the horizontal plane) intersected at a right angle to the vertical plane, and the vertical-load trussed structure composed of spaning the connecting members between the auxiliary horizontal member and one horizontal member being either the exterior horizontal member or the interior horizontal member arranged parallel to each other in the vertical plane, supports loads served from two directions of a horizontal direction and a vertical direction. Since the structure component is structured to support separately the load served from both of the directions at the each trussed structure, the strength of the trussed structures are each defined in response to the load serving to the trussed structure so as to enable efficiently the load support even if the loads are served in different largeness to respective directions.

Respective trussed structures have the one of the chord members in the trussed structures in common, so that the number of members is fewer and cost is lower than when the trussed structures are separately provided.

The structure of the present invention applies means of connecting pivotally the three horizontal members and the vertical members about pins, and when one pin connecting the one horizontal member (either the exterior horizontal member or the interior horizontal member) arranged at a juncture of the intersecting two directions of the trussed structures with the vertical structures and the other pin connecting the horizontal members (the auxiliary horizontal member and the other horizontal member being either the exterior horizontal member or the interior horizontal member) with the vertical structure are oriented to have each different direction at a right angle in the axis direction, an error produced in the production process between those horizontal members (between the one horizontal member being either the exterior horizontal member or the interior horizontal member, and the auxiliary horizontal member and the other horizontal member being either the exterior horizontal member or the interior horizontal member) is dispelled, so that the structure component is smoothly and certainly provided.

Furthermore, the change of the direction orienting the pins enable to define to serve shear force responding to the afore-mentioned loads supported the one pin oriented at position added mainly the vertical load and the other pin oriented at position added mainly the horizontal load, and the pins can support pivotally with greater strength, so that the loads can be certainly supported.

DETAILED DESCRIPTION OF THE PREFERRED EMBODIMENT(S)

Figure 1:
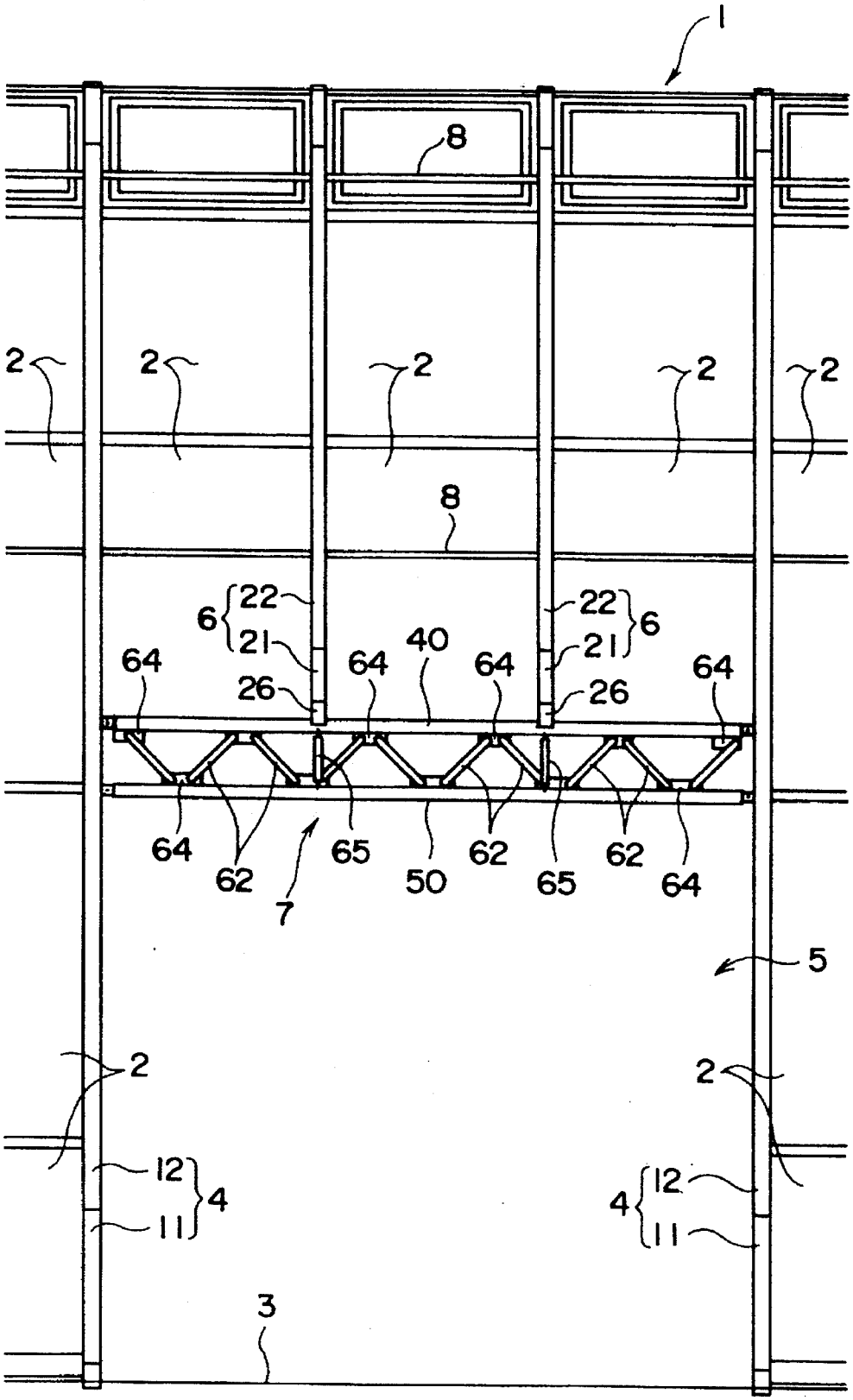
FIG. 1 is a front view of a curtain wall of a building employing a structural component in the preferred embodiment according to the present invention viewed from the inside.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

A preferable embodiment of the present invention will hereunder be explained with reference to attached drawings from FIG. 1 to FIG. 8. Referring first to the embodiment as shown in FIG. 1, in a building where main mullions 4 as a vertical structure from a floor slab 3 to a ceiling beam (not shown) erect at a predetermined interval between them to attach glass panels 2 on the curtain wall 1 composing an outer wall, the main mullions 4 are provided to suit width-dimension of an opening 5 and auxiliary mullions 6 having length-dimension from the upper opening 5 to the ceiling beam are provided between the two main mullions 4 with considering the different width-dimension of the opening 5 from those of the respective panels of the curtain wall 1 in order that the opening 5 is formed at wall surface of the curtain wall 1, thereby a structural component 7 in accordance with the present invention is provided between the main mullions 4 in order to prevent its strength from being weakened.

FIG. 1 illustrates an entire view of the outer wall, or the curtain wall 1 watching from the inside of the building. The preferable embodiment is applied for the curtain wall 1 under a so-called back-mullion system in which the main and auxiliary mullions 4, 6 are arranged in the interior of the glass panels 2.

Incidentally, between the mullions 4, 6 there are secured stainless tie rods 8 horizontally taking a reinforcement of the mullions 4, 6 in a stretched state.

The main mullion 4 should be understood as being structured by that taught in the Japanese Utility Model Application No. Hei 3-52672 (Japanese Utility Model Application Laid-open No. Hei 4-137115) disclosed by the present applicant. In brief, as can be known from FIG. 2, the main mullion 4 is assembled with an exterior vertical member 11 (chord member), an interior vertical member 12 (chord member) and plural lattice trusses 13 as a connecting member which is subsequently and slantwise connected to one another to connect both vertical members 11, 12 so as to compose a trussed structure. Regarding a standing state of the main mullion 4, the top and bottom portions of the exterior vertical member 11 are respectively connected with a ceiling beam (not shown) and the floor slab 3.

Figure 6:
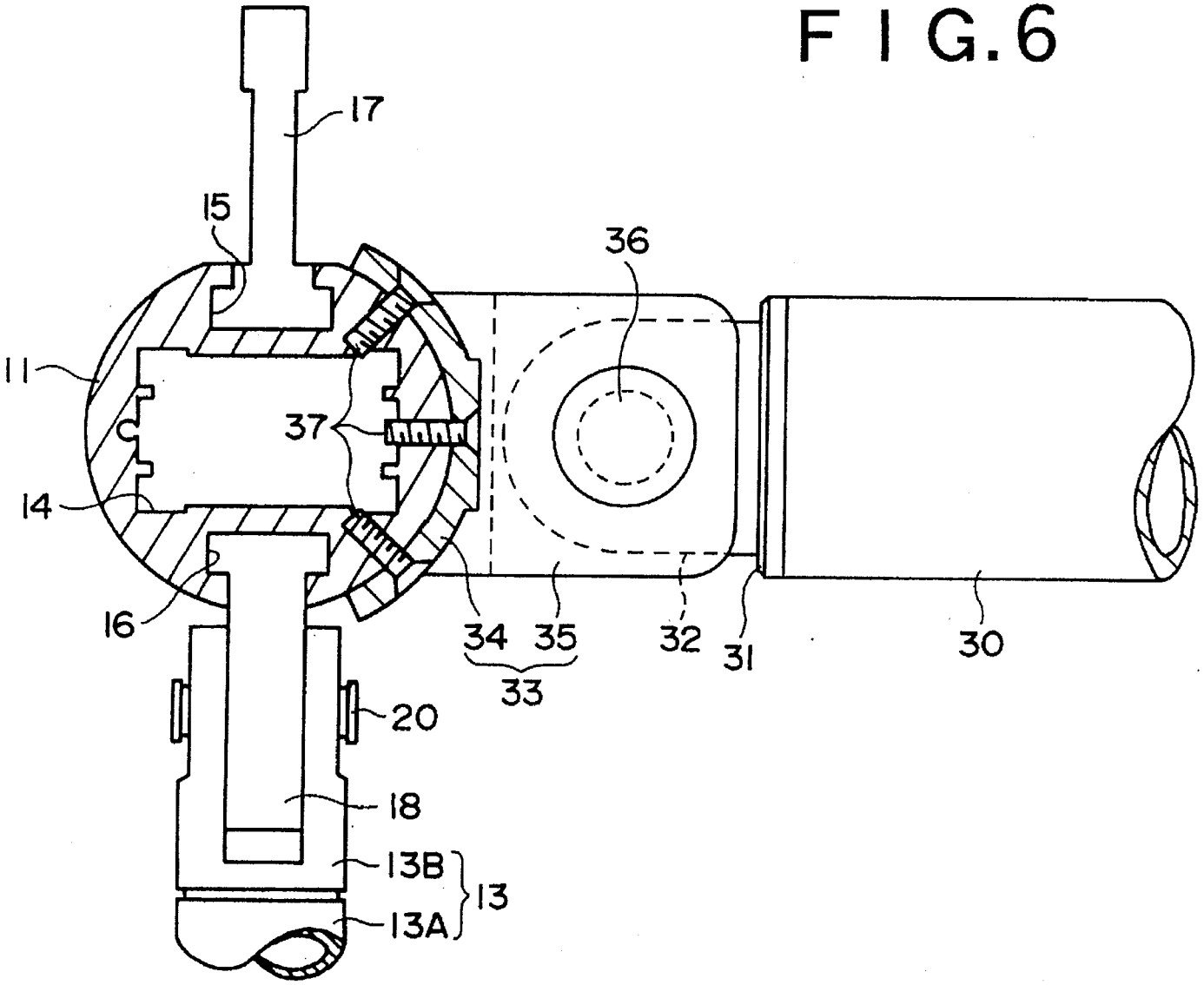
FIG. 6 is a sectional view taken along an 1—1 line in FIG. 5.
Figure 7:
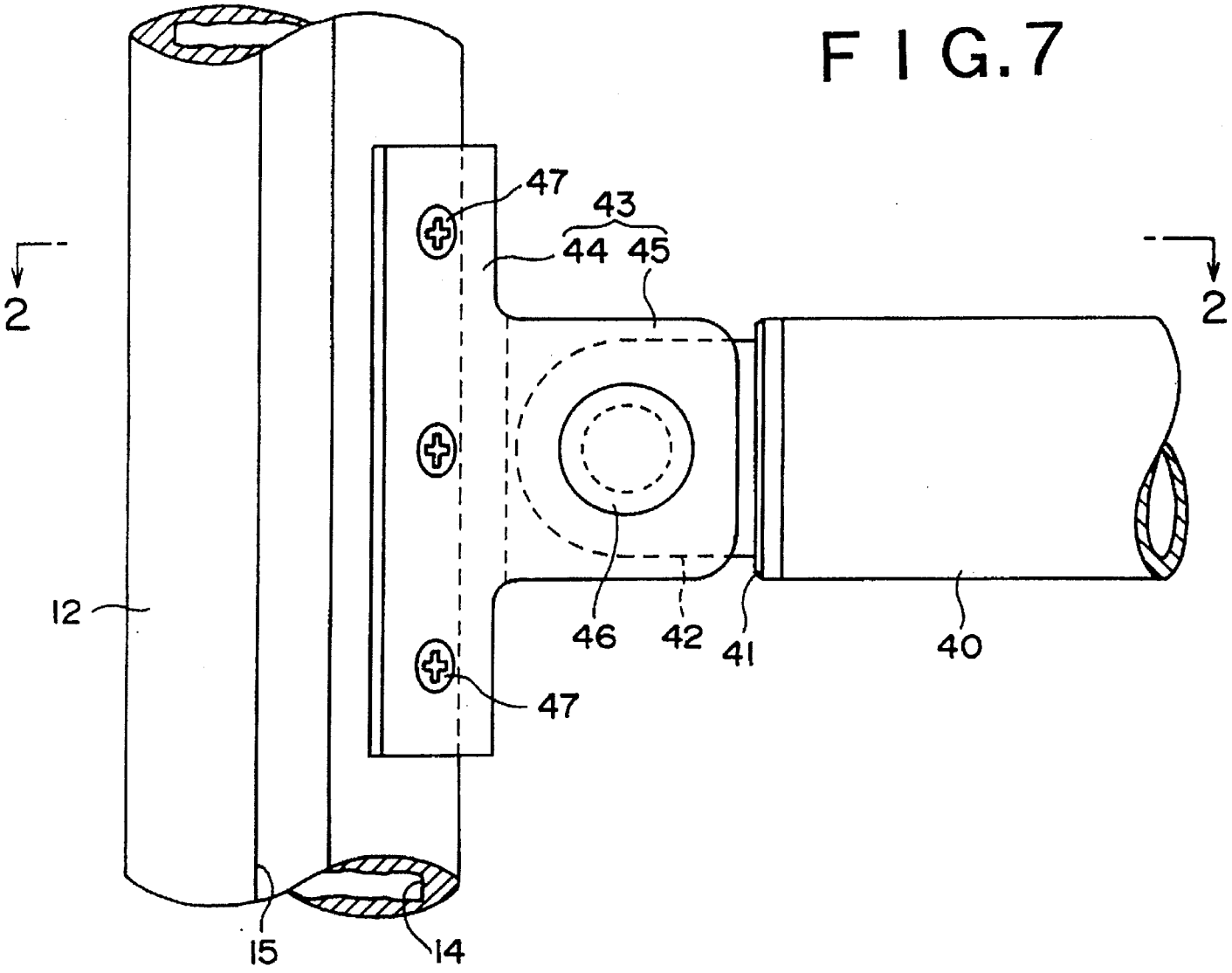
FIG. 7 is a side elevational view of a pin junction section seen at an interior horizontal member in the structural component in the same embodiment.
Figure 8:
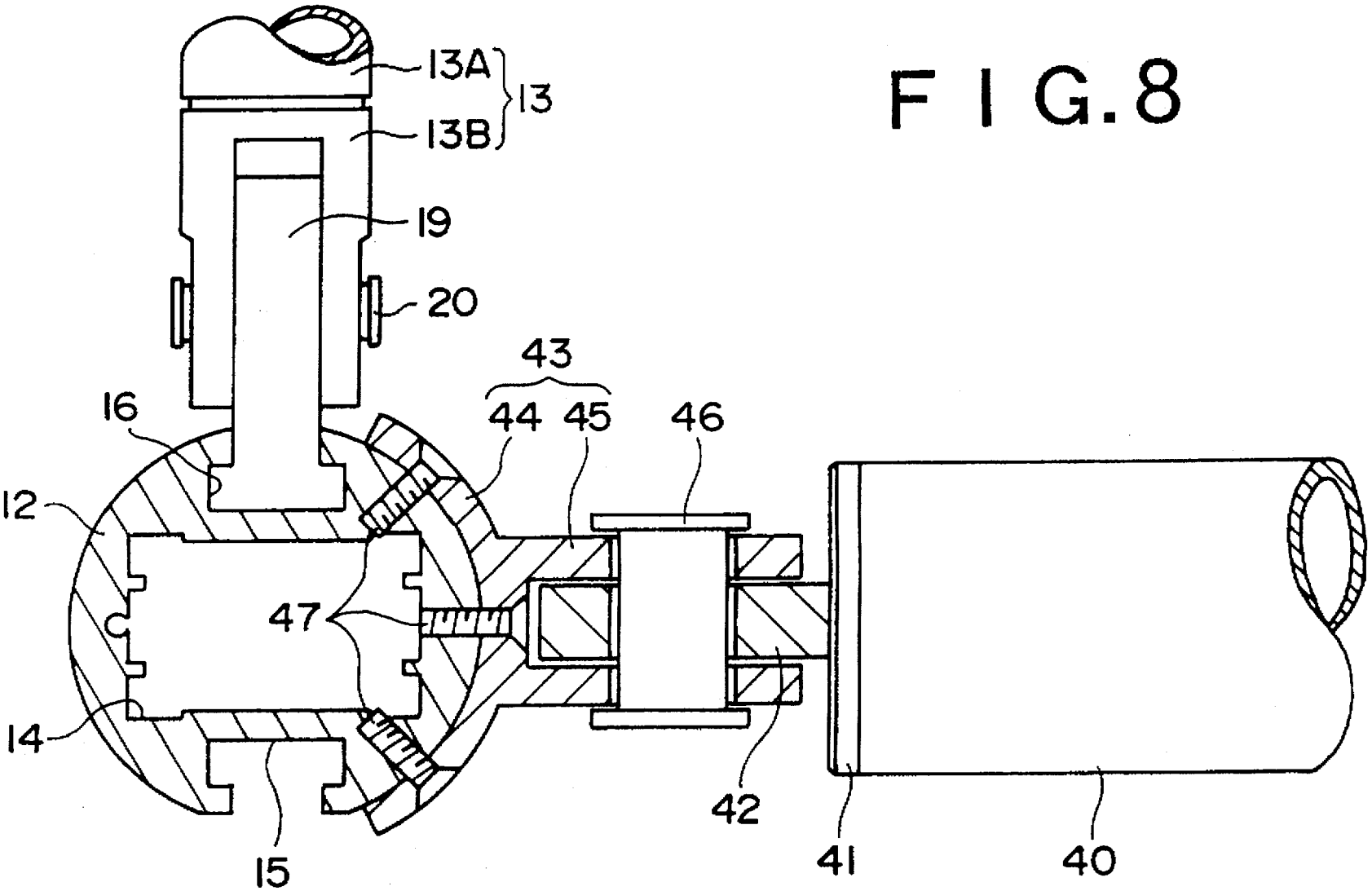
FIG. 8 is a sectional view taken along a line 2—2 in FIG. 7.
Figure 9:
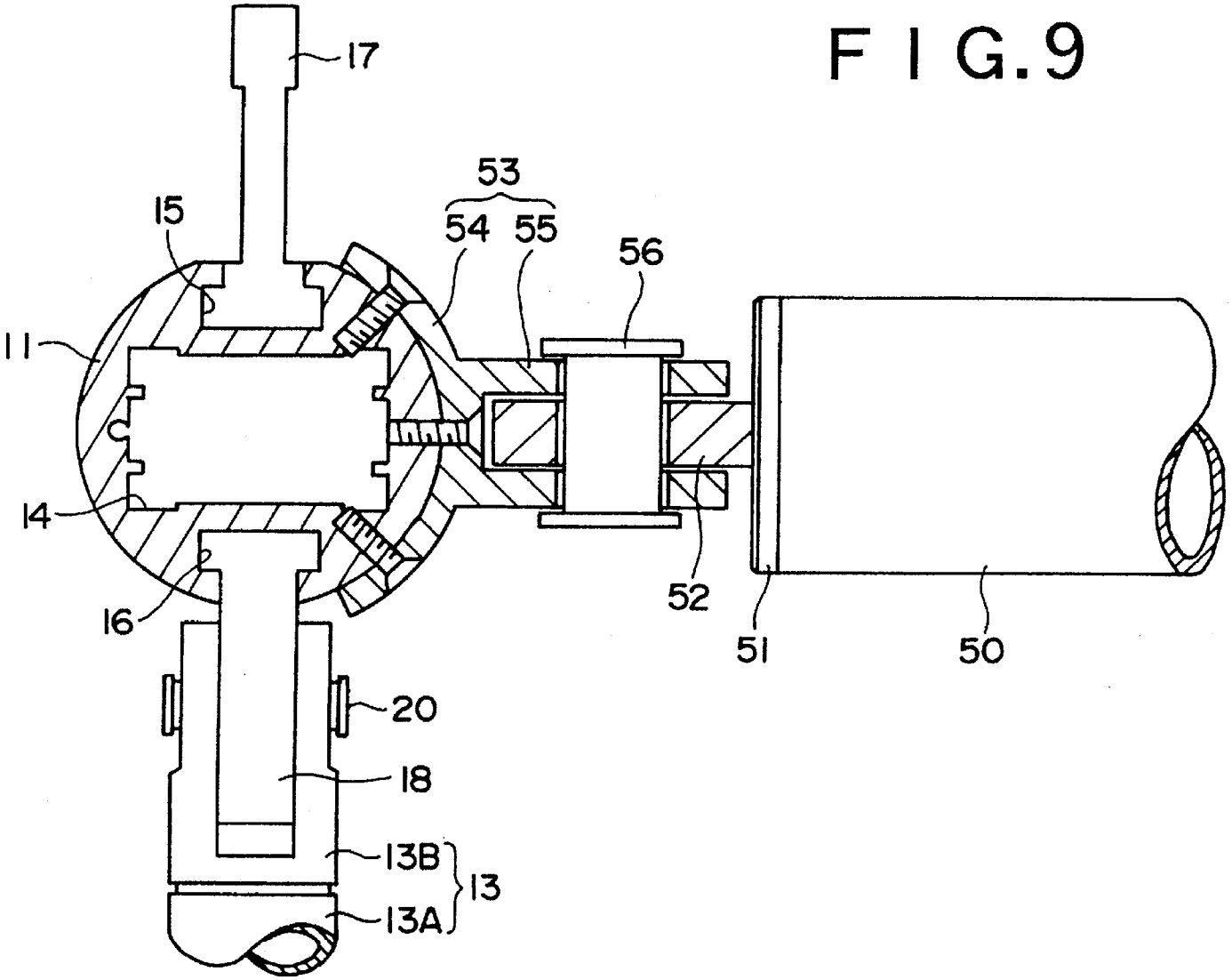
FIG. 9 is a plane sectional view of the pin junction section seen at a reinforcement horizontal member in the structural component in the same embodiment.

As shown in FIGS. 6, 8 and 9, the exterior vertical member 11 and the interior vertical member 12, which are made from aluminum by an extrusion molding method and the like, each has an almost round shaped outer surface (round pipe state) as a lengthy member including therein a rectangle hollow portion 14 at the central axis portion and first and second concave stripe grooves 15 and 16 which are continuously grooved to open toward outside in a longitudinal direction of the vertical member.

A support plate 17 is attached in the first concave stripe groove 15 of the exterior vertical member 11 to contact with and support a side of the glass panel 2 composing the wall surface of the curtain wall 1.

Figure 2:
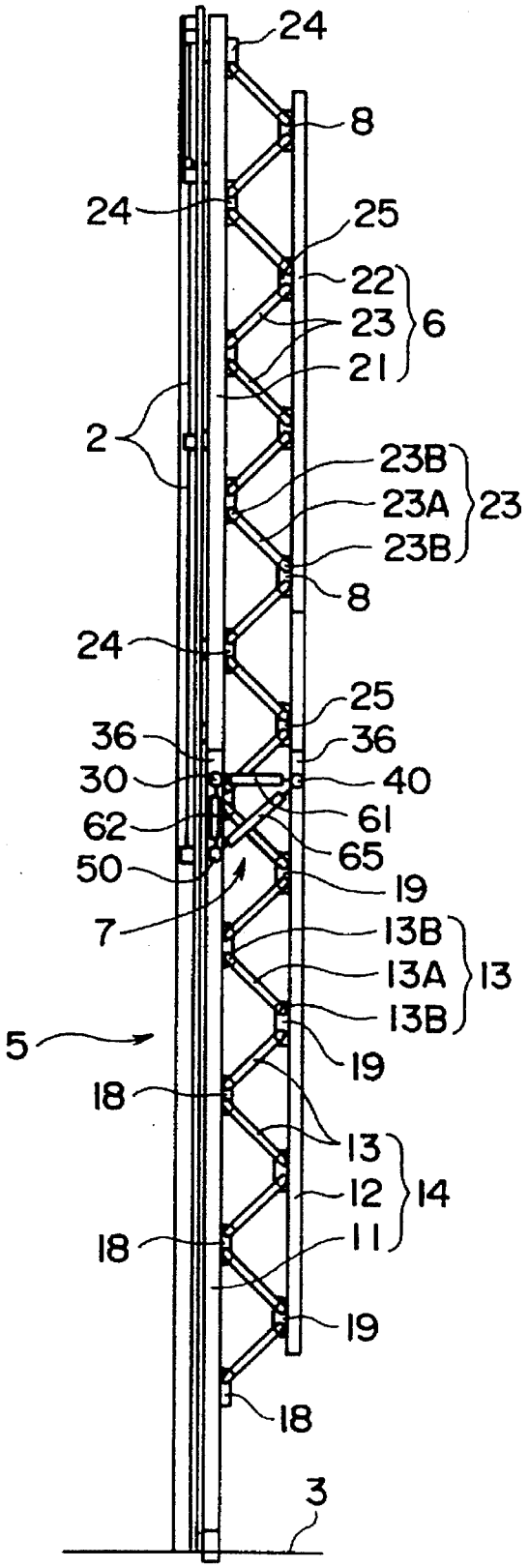
FIG. 2 is a side elevational view of a mullion and the structural component in the same embodiment.
Figure 4:
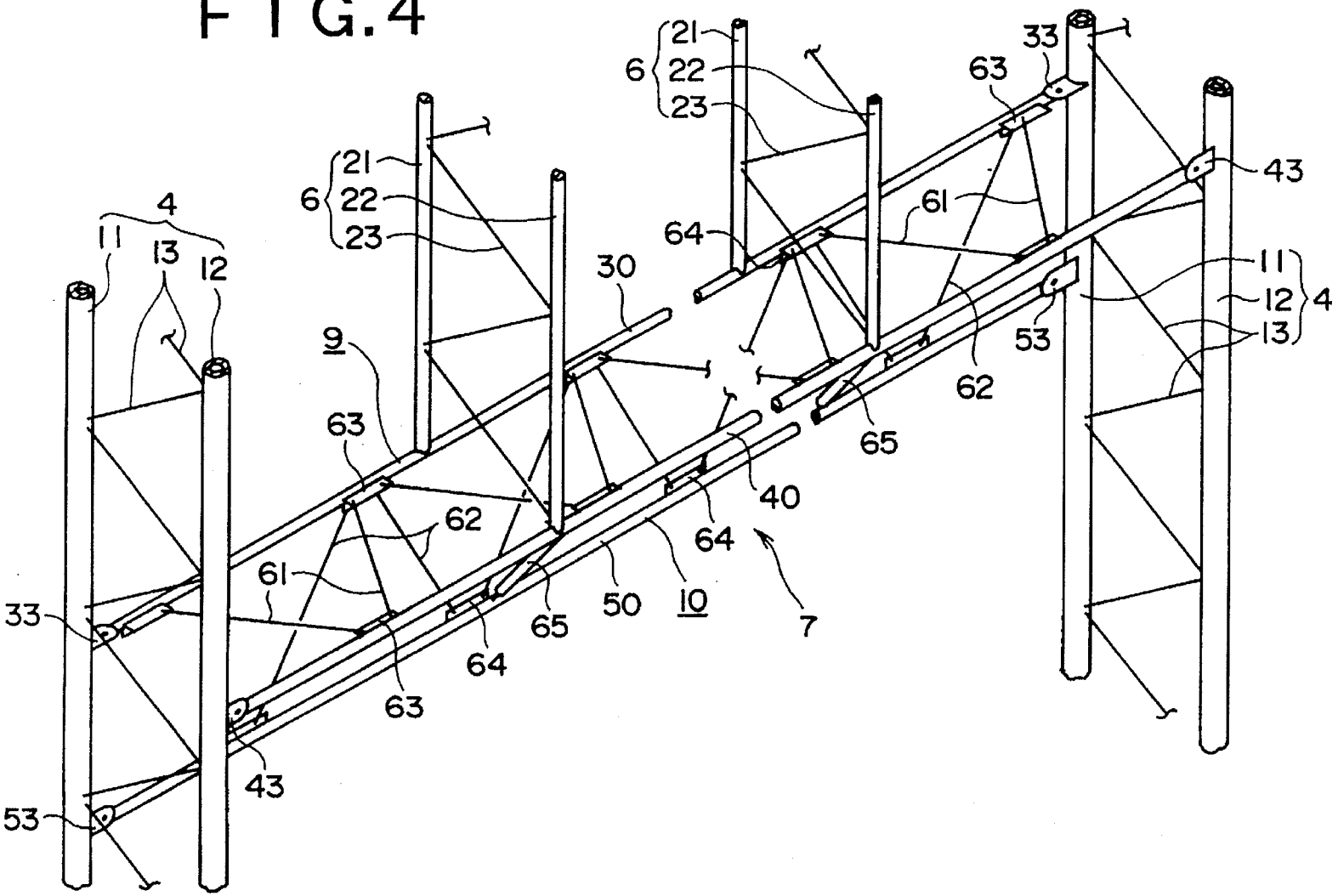
FIG. 4 is a perspective view of a diagrammatic structure of the structural component in the same embodiment.
Figure 5:
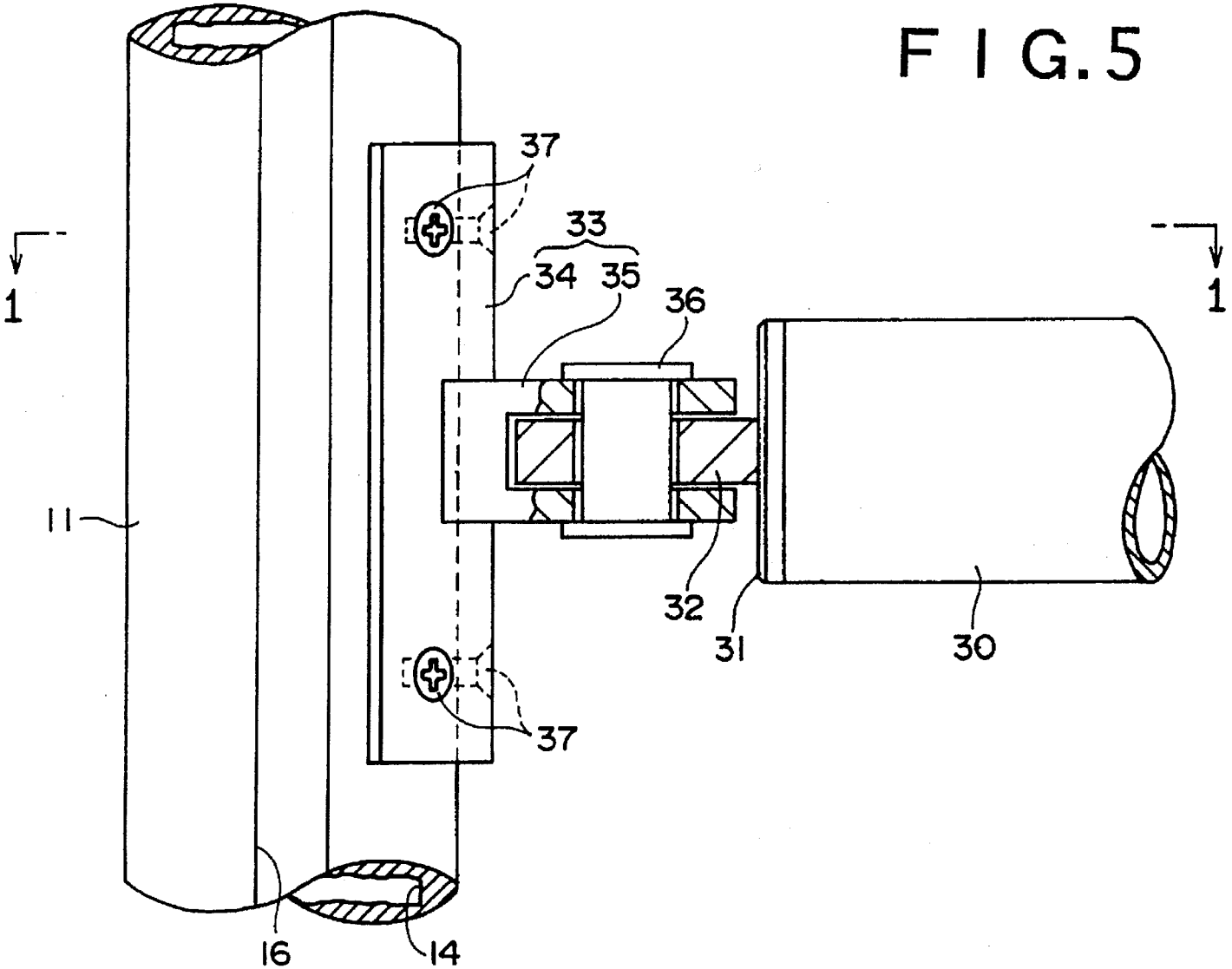
FIG. 5 is a side elevational view of a pin junction section seen at an exterior horizontal member in the structural component in the same embodiment.

And, in the second concave stripe grooves 16 formed respectively at opposite sides of the vertical members 11, 12, base sections of gusset plates 18, 19 are screwed by bolts and the like (not shown). As shown in FIGS. 2 and 4, the above-mentioned lattice truss 13 is pivotaly provided by means of a pin between the gusset plates 18,19. In brief, as can be seen from FIGS. 6, 8 and 9, the lattice truss 13 is assembled with a hollow pipe 13A and connecting brackets 13B attached at both ends of the hollow pipe 13A by means of bolts, by welding or integrally molding. Incidentally, the connecting brackets 13B and the gusset plate 18, 19 are connected pivotally by means of a connecting pin 20.

Now referring to the auxiliary mullion 6, it should be understood as structured as those in the above explained main mullion 4, which includes an exterior vertical member 21 (chord member) and an interior vertical member 22 (chord member) each having a length-dimension from the top of the opening 5 until the ceiling beam and being made from aluminum, and which further includes between these vertical members 21, 22 plural lattice trusses 23 as the connecting member which are subsequently connected one with the other in a vertical direction every certain intervals via gusset plates 24, 25. Accordingly, the auxiliary mullion 6 is to be the trussed structure.

In the auxiliary mullion 6, the top of the exterior vertical member 21 is connected with the ceiling beam (not shown) and respective bottom portions of the vertical members 21, 22 are connected with a structural component 7, which will be touched upon later by proper means such as bolts via connecting brackets 26 having a connecting surface curved in response to the shape of the structural component 7.

The auxiliary mullion 6, as shown in FIG. 4, includes the support plate 17 to support the glass panel 2 like the above-described main mullion 4. And as can be known from FIG. 2, a lattice truss 23 is composed of a hollow pipe 23A and a connecting bracket 23B and is pivotally connected to the gusset plates 24, 25 about a connecting pin (not shown).

As shown in FIG. 4, the structural component 7 includes a horizontal-load support trussed structure 9 and a vertical-load support trussed structure 10.

The horizontal-load support trussed structure 9 includes two chord members arranged parallely to each other in a same horizontal plane, one chord member being of an exterior horizontal member 30 arranged between the exterior vertical members 11 of the main mullions 4 and the other one being of an interior horizontal member 40 arranged between the interior vertical members 12 of the main mullions 4, and it further includes plural lattice trusses 61 as connecting member each of which is pivotaly arranged between the horizontal members 30 and 40 in a zigzag state.

The vertical-load support trussed structure 10 includes two chord members arranged parallel to each other in a same vertical plane, one chord member being of an exterior horizontal member 30 and the other one being of an auxiliary horizontal member 50 both arranged between the exterior vertical members 11 of the main mullions 4, and it further includes plural lattice trusses 62 as connecting member each of which is pivotally arranged between the horizontal members 30 and 50 in a zigzag state.

Figure 3:
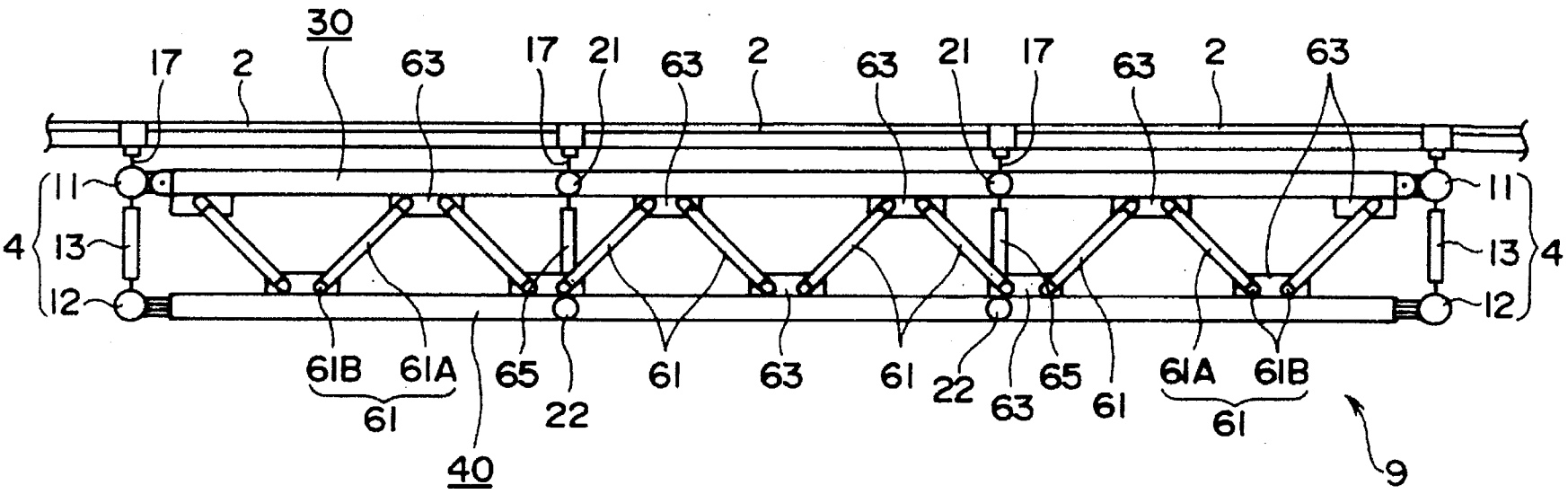
FIG. 3 is a top view of the structural component in the same embodiment.

As shown in FIGS. 1 and 3, the respective lattice trusses 61 and 62 are assembled with hollow pipes 61A and 62A and connecting brackets 61B and 62B as in the lattice trusses 13 and 23 jointed between the vertical members 11 and 12 in the main mullions 4 so that they are pivotally connected with gusset plates 63 and 64 secured on the horizontal members 30, 40 and 50 at the connecting brackets 61B and 62B. The connection of the gusset plate 63, 64 to the horizontal member 30, 40, 50 is obtained such that the base section thereof is coupled into the concave stripe groove formed at the horizontal members 30, 40, 50 and is thereafter screwed up.

As shown in FIGS. 5 to 9, there are connecting brackets 31, 41 and 51 connected in respective both ends of the three horizontal member 30, 40 and 50, which are made in round pipe state of aluminum by the extrusion molding method and the like, by bolting or screwing. A front view of the assembling structure of the auxiliary horizontal member 50 will be omitted and only its cross-sectional view is illustrated as FIG. 9 because of the almost same structure as the assembling structure for the interior horizontal member 40.

The connecting brackets 31, 41 and 51 are provided with plate members 32, 42 and 52. The plate member 32 attached to the exterior horizontal member 30 is oriented to allow the its front and back faces to be aligned with a horizontal plane and the other plate members 42, 52, respectively attached to the interior horizontal member 40 and the auxiliary horizontal member 50, are oriented to allow the front and back faces to be aligned with a vertical plane perpendicular to the plate member 32.

At respective positions on the exterior or interior vertical members 11, 12 correspondeing to the connecting brackets 31, 41 and 51, there are provided junction brackets 33, 43 and 53.

The junction brackets 33, 43 and 53 composed of base sections 34, 44 and 54 each having a semi-circular shape to suit the exterior surface of the vertical members 11, 12 and junction sections 35, 45 and 55 each having two plates to clamp the plate members 32, 42 and 52. The afore-mentioned connecting brackets 31, 41 and 51 (attached to the exterior horizontal member 30, the interior horizontal member 40 and the auxiliary horizontal member 50) and those junction brackets 33, 43 and 53 (secured on the exterior vertical member 11 and the interior vertical member 12) are pivotally connected to each other by means of contact pins 36, 46 and 56 received into the junction sections 35, 45 and 55 and the plate members 32, 42 and 52 as descrived above.

As can be known from the above, since the plate member 32 of the horizontal member 30 angularly differs from the plate members 42 and 52 of the horizontal members 40 and 50, the contact pin 36 of the horizontal member 30 is angularly oriented relative to the contact pins 46 and 56 at right angles.

Incidentally, the junction brackets 33, 43 and 53 are screwed up on the vertical members 11 and 12 by means of screws 37, 47 and 57 driven radially toward the central axis of the vertical members 11 and 12.

As shown in FIGS. 1, 2 and 4, between the interior horizontal member 40 of the horizontal-load support trussed structure and the auxiliary horizontal member 50 of the vertical-load support trussed structure, there are two reinforcement members 65 connecting them to each other. The reinforcement member 65 is disposed below the auxiliary mullion 6 connected on the structural component 7, or is assembled at a positon along a longitudinal direction of the auxiliary mullion 6 to meet the auxiliary mullion 6, and it is pivotally moved about a pin by a combination of the connecting brackets attached at both ends thereof and the connecting plates securely attached on the horizontal members 40, 50 by bolts or by welding.

Consequently, since the structural component 7 of the present invention includes the horizontal-load support trussed structure 9, the vertical-load support trussed structure 10 and the above-mentioned reinforcement member 65, it will be always acquired that the three of the horizontal members 30, 40 and 50 stay at respective tops in an intersecting section along a longitudinal direction and a combination of the lattice trusses 61, 62 and the reinforcement members 65 organizes triangles in a plane view.

In the foregoing embodiment, the main mullions 4 are erected in conformity with a width of the glass panel 2 or the opening 5, the auxiliary mullions 6 are provided by certain intervals therebetween over the opening 5, and the structural component 7 spans between the main mullions 4 for the opening 5.

The exterior horizontal member 30 and the interior horizontal member 40 of the structural component 7 and the auxiliary mullion 6 are connected to each other and the glass panels 2 are fitted between the mullions 4 and 6 to form a door way or a wind shield room at the opening 5 so as to structure the wall surface by the curtain wall 1.

Following effects can be expected in accordance with the afore-mentioned embodiment.

Since the structural component 7, which includes the horizontal-load support trussed structure 9 connected along a horizontal plane and the vertical-load support trussed structure 10 connected along a vertical plane, is provided between the main mullions 4, a load served in the vertical direction by dead-weight of the auxiliary mullion 6 and the glass panels 2 and a load served in the horizontal direction by wind-pressure force are supported by the structural component 7. Hence, even when the main mullions 4 are erected by a distance away from the general position to form the opening 5, the structural component 7 is capable of obtaining enough supporting strength and of determining the structuring position in height in relation to the main mullions 4. Accordingly, the opening 5 having large length and width dimensions to prepare the door way or the wind shield room can be formed at the curtain wall surface.

The structural component 7 is composed of two trussed structures, one being of the horizontal-load support trussed structure 9 mainly supporting the load served in the horizontal plane and the other being of the vertical-load support trussed structure 10 mainly supporting the load served in the vertical plane, so that the strength of the two trussed structures 9 and 10 can be separately controlled in ways and means by regulating number of the lattice trusses 61, 62 or appropriately selected material, thickness or the like of the structuring members. Therefore, even when the loads served in the horizontal and vertical directions have different magnitudes, the strength can be separately determined in response to the load so as to be able to received the load with support in a dynamically effective condition.

Consequently, the structural component 7 of the present invention is exceedingly suited for reinforcement, in particular, of the mullions 4 and 6 supporting various panels 2 on the curtain wall 1.

Furthermore, since the structural component 7 arranges therein the reinforcement member 65 between the interior horizontal member 40 and the auxiliary horizontal member 50, the structural component 7 can be structured to be three-dimensional to complement the load support in both of the trussed structures 9 and 10 so as to advance the strength of the structural component 7. Particularly, in the afore-mentioned embodiment, the load support can be effectively complemented because the reinforcement members 65 are provided under the connecting positions with the auxiliary member 6, where the load added to the structural component 7 is increased.

In the afore-mentioned embodiment, both of the trussed structures 9 and 10 are not separately formed, but the exterior horizontal member 30 as the chord member is utilized for both of the trussed structures 9 and 10 in common, so that a product is offered for a low price by small cost resulted from the fewer pans.

The certain strength can be assured even if small section is utilized for the structural components such as the horizontal members 30, 40 and 50 and the lattice trusses 61, 62 because the structural component 7 is composed of the trussed structures 9 and 10. Accordingly, a wide view (open) watching into and from a room can be advanced because it can be sufficient that the structural component 7 occupies smaller space.

Regarding to the structural component 7 composed of the three horizontal members 30, 40 and 50, the contact pins 36 pivotally connecting the exterior horizontal member 30 is angularly oriented at right angles relatively to the contact pins 46, 56 pivotally connecting the interior horizontal member 40 and the auxiliary horizontal member 50, so that productive errors, for example errors presented at sections pivotally supported among the horizontal members 30, 40 and 50 by means of pins, can be dispelled.

Or at the sections pivotally connected with the horizontal members 30, 40 and 50 by means of pins, a small aperture is kept between the plate members 32, 42 and 52 of the connecting brackets 31, 41 and 51 and the junction sections 35, 45 and 55 of the junction brackets 33, 43 and 53, so that in the axis direction for the contact pins 36, 46 and 56, an assembling error at each section can be dispelled. Since the contact pin 36 is angularly oriented at right angles in relation to the contact pins 46 and 56, the exterior horizontal member 30 is not always oriented on parallel with the interior horizontal member 40 and the auxiliary horizontal member 50 which are connected to the horizontal member 30 via the lattice trusses 61 and 62, for example, due to the productive error, the assembling error of the lattice trusses 61 and 61, however even if a dimensional error is presented among the three horizontal members 30, 40 and 50, those errors can be dispelled by the afore-mentioned aperture between the junction sections 35, 45 and 55 in the junction brackets 33, 43 and 53.

Therefore, disadvantages which the structural component 7 can not be pivotally connected with the main mullions 4 because of the productive error will not occur, so that the connection is assured and a connecting productivity can be advanced.

The afore-illustrated change of the direction, which the contact pin 36 is oriented at right angles to the contact pins 46 and 56, causes the contact pin 36 mainly applied for the vertical load and the contact pins 46 and 56 mainly applied for the horizontal load to receive shear force, so that the strength assured by those pins pivotaly connecting can be increased and the loads served to every direction can be certainly supported in the structural component 7.

Since the junction brackets 33, 43 and 53 pivotally connected with the three horizontal members 30, 40 and 50 by means of pins are screwed by the screws 37, 47 and 57 secured radially toward the central axis direction on the vertical members 11 and 12, those junction brackets 33, 43 and 53 can be certainly screwed into the vertical members 11 and 12 and the welding operation is unnecessary so as to make productivity advance.

Furthermore, all of the main mullions 4, the auxiliary mullions 6 and the structural component 7 are of the trussed structures and the respective vertical members 11, 12, 21 and 22 are pivotally connected via the three horizontal members 30, 40 and 50 by means of pins so as to obtain a structural unit, and the load is smoothly transmitted but is not concentrated to a weak locate in strength, so that a fine load-support structure can be achieved. Incidentally, even if the mullions 4, 6 or the structural component 7 are/is bared from the wall surface, a designing united impression and functional beauty can be obtained and an appearance of the curtain wall 1 can be advanced because of the trussed structures.

It is to be understood that the present invention is not intended to be limited to the above-described embodiments, and various changes may be made therein without departing from the spirit of the present invention. Such changes are also included in the scope of the present invention.

Figure 10:
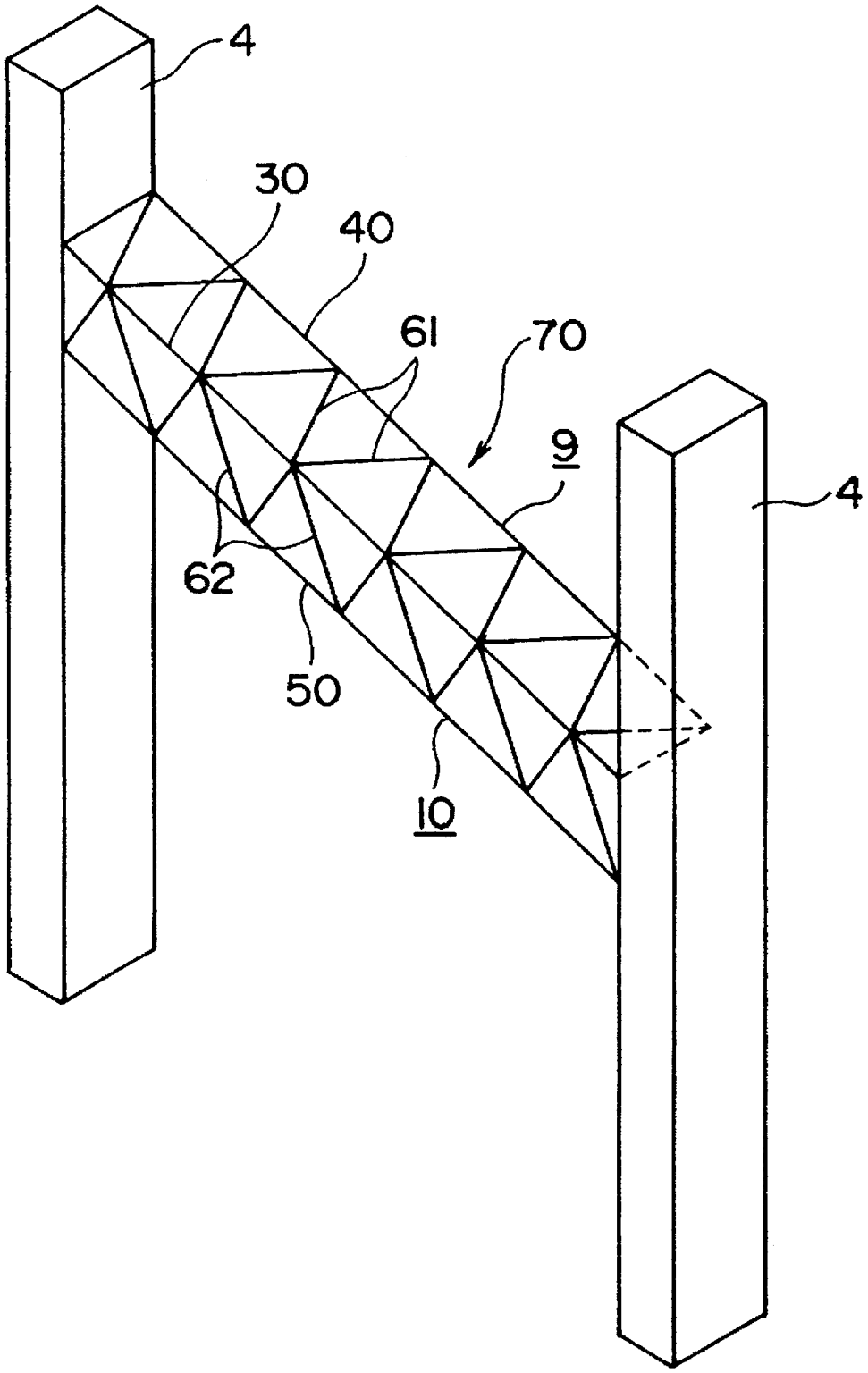
FIG. 10 is a diagrammatic perspective view of a modified embodiment in accordance with the present invention.

For example, according to the afore-mentioned embodiment, the horizontal-load support trussed structure 9 causes the two horizontal members 30 and 40 to arrange on parallel with each other in the same horizontal plane, however, as illustrated in FIG. 10, when it is necessary that a structural component 70 is slantwise oriented at the predetermined angle against the horizontal plane, the two horizontal members 30 and 40 may be arranged in parallel with each other in a plane slanted from the horizontal plane. In a word, since the horizontal-load support trussed structure 9 may be structured to be able to support the load adding in the horizontal direction like the wind pressure force adding to the glass panels 2 and the like, a direction providing the trussed structure 9 can be appropriately defined in response to a design of the building and so on.

And the auxiliary horizontal member 50 is arranged downward the exterior horizontal member 30 in the afore-mentioned embodiment, however, the auxiliary horizontal member 50 can be arranged upward the exterior horizontal member 30 or upward or downward the interior horizontal member 40, or a position of the arrangement may be appropriately defined in accordance with every embodiment.

The horizontal-load support trussed structure 9 and the vertical-load support trussed structure 10 are arranged along the horizontal direction and the vertical direction respectively in the afore-mentioned embodiment, but it is not intended that the trussed structure 9 and 10 should be limited to be arranged to the horizontal direction and the vertical direction in the strict sense of the word. It may be understood that the trussed structure 9 and 10 are arranged along about horizontal direction and about vertical direction respectively, and it can be permitted that a dislocation of about 10 degree or less therein is produced by the assembling error and so on.

As known from FIG. 10, the members of the trussed structure are utilized for the main mullions 4 and auxiliary mullions 6 in the afore-mentioned embodiment, but these mullions 4 and 6 may be of other mullions having various shapes and materials, for example, quadrangular pipe, wide flange shape, angle steel member. Incidentally, if the mullions 4 and 6 are to be the trussed structures, there may be obtained some merits of the designing united impression and the structural unit.

The three horizontal members 30, 40 and 50, the lattice trusses 61 and 62, the auxiliary members 65 and the like in the structural component 7 are not limited to the round-shaped pipe made of aluminum and so on, but are also available to utilize others having various shapes having, for example, square pipe, round bar, square bar, angle steel member and various materials such as stainless, steel. Utilizing the round-shaped pipe made of aluminum, there may be obtained some merits of lightweight, high strength and easy productive process.

The afore-mentioned embodiment is not intended to be limited to the structure defined as the trussed structures 9 and 10 of the horizontal-load support trussed structure and the vertical-load support trussed structure, and it may be acknowledged employing well-known various trusses structures, for example, which is included connecting members composed of the lattice trusses 61, 62 and a bundle member. It is accepted that the structural component 7 is integrated with the trussed structure 9 and 10 as the horizontal-load support trussed structure and the vertical-load support trussed structure in the afore-mentioned embodiment, but these trussed structures may be separately formed as an individual. Incidentally, in the same way as the afore-mentioned embodiment, the trussed structure as the individual is recommended to form triangles in an intersecting section of a longitudinal direction by means of connecting one end of the chord members with each other to make tops and of spanning the reinforcement member between the other chord members to make three sides in order to obtain the strength.

The connecting positions of the reinforcement members 65 may not be always defined positions meeting with the auxiliary mullions 6 as described in the afore-mentioned embodiment, but the reinforcement members may be oriented at positions capable of gaining the strength support in response to the arranging number, an arranging interval of the auxiliary mullions 6.

Regarding to the structural component 7 connected pivotally with the vertical members 11, 12 at both ends of respective horizontal members 30, 40 and 50 of the structural component 7 by means of pins in the afore-mentioned embodiment, in the case of the structural component 7 or the vertical structures (the main mullion 4, the auxiliary mullion 6) which are made of steel or another, they may be connected by means of welding, or the connecting method may be selected in response to a building planed to build, materials of members used and so on.

And when the structural component 7 is pivotally connected by means of pins, as described in the afore-mentioned embodiment, the directions in an axis direction of the contact pins 36, 46 and 56 may be met at both ends of respective horizontal members 30, 40 and 50, in brief, the concrete structure can be appropriately defined in accordance with every embodiment.

The structural component of the present invention, which are employed in the reinforcement between the main and auxiliary mullions of the curtain wall 1 in the afore-mentioned embodiment, can be utilized for various ways such as all sort of beams in a building, preferably, for a section in which is needed to support loads from the horizontal direction and the vertical direction.

According to the present invention, since the structural components, which are composed of the trussed structures as the horizontal-load support trussed structure and the vertical-load support trussed structure to support the loads from the horizontal direction and the vertical direction, are arranged between the vertical structures such as the mullions, enough strength of the structure can be obtained even if the vertical structures are erected a distance away from general positions. Arranging the structural component of the present invention between the mullions supporting the panels of the curtain wall, the large opening can be formed at the curtain wall surface to form the door way or the wind shield room because the interval arranged between the side by side mullions can be defined as longer.

In the present invention, whereas the loads served in the horizontal direction and the vertical direction can be separately supported at the trussed structures of the horizontal-load support trussed structure and the vertical-load support trussed structure, the strength of the trussed structures can be determined in response to the loads served in each different largeness every direction. Hence, the loads can be efficiently supported.

The structural component is composed of the trussed structures as the horizontal-load support trussed structure and the vertical-load support trussed structure, so that the strength can be increased and structural component can be lightweight so as to obtain fine structural component in function even when the small section member is utilized for the structural component, for example, the lattice truss, the horizontal members as the chord members.

Incidentally, the use of the small section members is available for the smaller space occupied with the structural component and for the betterment of the wide view (open) through the opening so as to obtain fine structural component in design.

Since the horizontal-load support trussed structure is structured to span lattice trusses between the exterior horizontal member and the interior horizontal member and the vertical-load support trussed structure is structured to span lattice trusses between one of which the exterior horizontal member or the interior horizontal member and the auxiliary horizontal member, in brief, one of the two chord members in one trussed structure is applied to both of the two trussed structures in common, fewer member structure causes low cost.

Structuring to span the reinforcement member between the auxiliary horizontal member and one of which the exterior horizontal member or the interior horizontal member in the horizontal-load support trussed structure, the auxiliary horizontal member complements the load support served for two horizontal and vertical directions in the trussed structures, whereupon the three dimensional structural component including the trussed structures is structured so as to increase the strength of the structural component.

Regarding application of the trussed structures including the three horizontal members as the structural component and the means for connecting pivotally the horizontal member with the vertical member about pins, when one contact pin connecting the horizontal member (any one of the exterior horizontal member or the interior horizontal member) assembled at the juncture of the trussed structures crossing at a right angle toward two directions with the vertical structure and other contact pin connecting other horizontal member (any one of the exterior horizontal member or the interior horizontal member and the auxiliary horizontal member) with the vertical structure are oriented to have different direction at a right angle to each other, between those horizontal members (between one of the exterior horizontal member or the interior horizontal member, and other the exterior horizontal member or the interior horizontal member and the auxiliary horizontal member) there might be produced the error such as the productive error, but the error can be dispelled at the above-mentioned section connecting pivotally about a pin. Therefore, the structural component can be certainly and smoothly oriented.

The change in the direction of the pins at a right angle causes both of the pin added mainly the vertical load and the pin added mainly the horizontal load to be able to be defined to add shear force, so that the strength of those pins connecting pivotally can be increased and the loads served to every direction can be certainly supported.

Furthermore, structuring the structural component with the three horizontal members (the exterior horizontal member, the interior horizontal member and the auxiliary horizontal member) and the lattice trusses connecting between respective horizontal members, and further structuring the vertical structure connected the above structural component to span the lattice member between the exterior vertical member and the interior vertical member, the vertical structure and the structural component of the present invention can obtain a structural unit and a designing united impression and are able to be effected for betterment of the appearance in spite of bearing the structural component in or out the wall surface.

What is claimed is:

1. A structural component configured to be provided between vertical mullions in a building, the structural component comprising;

a horizontal-load support portion including a first horizontal member and a second horizontal member arranged parallel to each other in a plane, and a first plurality of connecting members connected to span between the first and second horizontal members;

a vertical-load support portion including the first horizontal member of said horizontal-load support portion, an auxiliary horizontal member arranged above or below the first horizontal member, and a second plurality of connecting members connected to span between the auxiliary horizontal member and the first horizontal member; and at least one reinforcement member connected between the auxiliary horizontal member and the second horizontal member, said reinforcement member being generally normal to both the auxiliary horizontal member and the second horizontal member;

wherein the first horizontal member, the second horizontal member and the auxiliary horizontal member include connecting means for pivotally connecting the respective horizontal members with the vertical mullions, said connecting means including contact pins; and wherein the contact pins effecting a connection of the first horizontal member and the contact pins effecting connections of the second horizontal member and of the auxiliary horizontal member are angularly oriented at right angles.

2. A structural component according to claim 1, wherein the first horizontal member and the second horizontal member are parallel to each other in a horizontal plane.

3. A structural component amending to claim 1, wherein the first horizontal member and the second horizontal member are parallel to each other in a plane slanted from a horizontal plane.

4. A structural component according to claim 1, wherein the first horizontal member, the second horizontal member, the auxiliary horizontal member and the connecting members are formed from aluminum pipe.

5. A structural component according to claim 1, wherein the respective connecting members are pivotally connected to and arranged among the first horizontal member, and the second horizontal member in a zigzag pattern.

6. A structural component according to claim 1, wherein the first horizontal member is an exterior member.

7. A structural component according to claim 1, wherein the first horizontal member is an interior member.

8. A structural component according to claim 1, wherein the second horizontal member is an exterior member.

9. A structural component according to claim 1, wherein the second horizontal member is an interior member.

10. A building support structure comprising:

a first mullion including a first interior vertical member and a first exterior vertical member arranged in parallel, and a first plurality of connecting members connecting the first interior vertical member with the first exterior vertical member;

a second mullion including a second interior vertical member and a second exterior vertical member arranged in parallel, and a second plurality of connecting members connecting the second interior vertical member and the second exterior vertical member;

a horizontal-load support portion provided between the first and second mullions, including a first horizontal member and a second horizontal member arranged parallel to each other in a plane, and a third plurality of connecting members connected to span between the first and second horizontal members;

a vertical-load support portion provided between the first and second mullions, including the first horizontal member of said horizontal-load support portion, an auxiliary horizontal member arranged above or below the first horizontal member, and a fourth plurality of connecting members connected to span between the auxiliary horizontal member and the first horizontal member; and at least one reinforcement member connected between the auxiliary horizontal member and the second horizontal member, said reinforcement member being generally normal to both the auxiliary horizontal member and second horizontal member;

wherein the first horizontal member, the second horizontal member and the auxiliary horizontal member include connectors configured to pivotally connect the respective horizontal members with the vertical mullions, said connectors including contact pins; and wherein the contact pins effecting a connection of the first horizontal member and the contact pins effecting connections of the second horizontal member and of the auxiliary horizontal member are angularly oriented at right angles.

11. A building support structure according to claim 10, wherein the first horizontal member is connected to span between the first and second exterior vertical members.

12. A building support structure according to claim 10, wherein the first horizontal member is connected to span between the first and second interior vertical members.

13. A building support structure according to claim 10, wherein the auxiliary horizontal member is connected to span between the first and second exterior vertical members.

14. A building support structure according to claim 10, wherein the auxiliary horizontal member is connected to span between the first and second interior vertical members.

15. A building support structure according to claim 10, wherein a vertical auxiliary mullion projects from one of the respective horizontal members of said horizontal-load support portion.

16. A building support structure according to claim 15, wherein said reinforcement member is connected at a position between the auxiliary horizontal member and the second horizontal member to correspond to a connecting position of the auxiliary mullion.

17. A curtain wall comprising:

at least two spaced apart main vertical mullions;

at least one vertical auxiliary mullion positioned intermediate the at least two main mullions and having a bottom end;

a structural component extending between the main mullions and supporting the bottom end of the auxiliary mullion, the structural component comprising:

(a) a horizontal-load support portion including a first horizontal member and a second horizontal member arranged parallel to each other in a plane, and a first plurality of connecting members connected to span between the first and second horizontal members;

(b) A vertical support portion including the first horizontal member of said horizontal-load support portion, the auxiliary horizontal member arranged above or below the first horizontal member, and a second plurality of connecting members connected to span between the auxiliary horizontal member and the first horizontal member; and (c) at least one reinforcement member connected between the auxiliary horizontal member and the second horizontal member, said reinforcement member being generally normal to both the auxiliary horizontal member and the second horizontal member; and a plurality of glass panels supported by the main mullions and the auxiliary mullion.

* * * * *